US005678290A

United States Patent [19]

Good

[11] Patent Number: 5,678,290

[45] Date of Patent: Oct. 21, 1997

[54] METHOD OF MANUFACTURING A PAGE WIDE INK JET PRINTHEAD

[75] Inventor: Lowell M. Good, Cypress, Tex.

[73] Assignee: Compaq Computer Corporation

[21] Appl. No.: 510,969

[22] Filed: Aug. 3, 1995

Related U.S. Application Data

[62] Division of Ser. No. 909,026, Jul. 6, 1992, Pat. No. 5,440, 332.

[51] Int. Cl.[6] ..... H04R 17/00

[52] U.S. Cl. ..... 29/25.35; 346/140 R; 346/140 PD

[58] Field of Search ..... 29/25.35, 825; 346/140 R, 140 PD

[56] References Cited

U.S. PATENT DOCUMENTS

| | | | |
|---|---|---|---|
| 4,312,009 | 1/1982 | Lange | 346/140 |
| 4,510,509 | 4/1985 | Horike et al. | 346/140 |
| 4,580,148 | 4/1986 | Domoto et al. | 347/42 X |
| 4,768,266 | 9/1988 | DeYoung . | |
| 4,887,100 | 12/1989 | Michaelis et al. | 346/140 R |
| 5,072,240 | 12/1991 | Miyazawa et al. | 29/25.35 X |
| 5,189,437 | 2/1993 | Micheelis et al. . | |
| 5,252,994 | 10/1993 | Narita et al. | 346/140 R |

FOREIGN PATENT DOCUMENTS

| | | |
|---|---|---|
| 0485241 | 5/1992 | European Pat. Off. . |
| 242594 | 2/1987 | German Dem. Rep. . |
| 61-037438 | 2/1986 | Japan . |

*Primary Examiner*—Carl J. Arbes

*Attorney, Agent, or Firm*—Vinson & Elkins L.L.P.

[57] ABSTRACT

A page wide ink jet printhead employed in a printer for printing characters on a print medium. The print medium progresses in a path through the printer during printing. The page wide ink Jet printhead includes print nozzles selectively aligned across the width of the print medium allowing the printhead to remaining stationary; a means for selectively ejecting ink through particular nozzles, which means is formed of a piezoelectric material which has microgrooves therein; ink residing in the microgrooves for ejection therefrom; sidewalls of the microgrooves which act as actuators to cause ink to be ejected from the microgrooves in response to an electrical pulse supplied thereto; and electrical circuitry to appropriately direct the electrical pulse to create an electric field across particular microgrooves to obtain a desired print character formed from ink droplets ejected from the microgrooves.

10 Claims, 1 Drawing Sheet

METHOD OF MANUFACTURING A PAGE WIDE INK JET PRINTHEAD

This application is a divisional application of 909,026 filed Jul. 6, 1992 U.S. Pat. No. 5,440,332, issued Aug. 8, 1995, entitled "APPARATUS FOR PAGE WIDE INK JET PRINTING".

BACKGROUND OF THE INVENTION

1. Field of the Invention

The invention relates to a method and apparatus for ink jet printing, and, more particularly, to a method and apparatus for ink Jet printing by a page wide ink jet printhead.

2. Description of the Related Art

Printers are one of the most popular computer peripherals. Not surprisingly, therefore, the rapid growth in acceptance, use, and numbers of computers during the past fifteen years has fueled the demand for, and interest in the development of, printers.

Presently employed printing techniques may generally be categorized as either impact printing or non-impact printing depending upon whether some portion of the printer "strikes" the print medium upon which characters are being printed. In an impact printer, some portion of the printer does strike the medium, e.g. , paper. In a non-impact printer, on the other hand, only ink contacts the medium.

One of the most widely used types of non-impact printers at the present time is the so-called "ink jet printer." In ink Jet printing, ink is ejected, most commonly by pressure, through a tiny nozzle to form an ink droplet that may be deposited on a paper medium. Ink jet printers have been developed that are capable of producing highly reproducible and controllable droplets. Using those printers, it is now possible for a droplet to be deposited at a location specified by digitally stored data.

Most commercially available ink Jet printing systems may be generally classified as either "continuous Jet" or "drop on demand" type. In a "continuous jet" type ink jet printing system, ink droplets are continuously ejected from a printer printhead and either directed to or away from a paper medium depending on the desired image to be produced. In such a continuous jet system, uniform ink droplets are formed from a stream of liquid continuously issuing from an orifice. A mechanism, often of an electromechanical material, such as piezoelectric material, oscillates in response to an applied voltage to cause break-up of the continuous stream into uniform droplets of ink and to impart an electrostatic charge to the droplets. High voltage deflection plates located in the vicinity of the ejected ink droplets selectively control the trajectory of the ink droplets causing the droplets to hit a desired spot on the paper medium. Since a continuous flow of ink is employed in this type system, it is referred to as continuous.

In a "drop on demand" type ink Jet printing system, ink droplets are intermittently ejected from a printhead in response to a specific command related to the image to be produced. "Drop on demand" ink droplets are produced as a result of electromechanically induced pressure waves. The pressure waves are induced by applying a voltage pulse to an electromechanical material, e.g., a piezoelectric material, which is directly or indirectly coupled to a stored fluid. The pressure waves cause pressure/velocity transients to occur in the ink and these transients are directed so as to produce a droplet that issues from a reservoir or channel in the printhead, typically through an orifice. Since voltage is applied only when a droplet is desired, these types of ink jet printing systems are referred to as drop-on-demand.

As may be gathered from the discussion above, the use of piezoelectric materials in ink jet printers is well known. Most commonly, the piezoelectric materials are used in the form of a piezoelectric transducer by which electric energy is converted into mechanical energy. This conversion is caused by application of an electric field across the piezoelectric material, thereby causing the piezoelectric material to deform. This ability to distort piezoelectric material by application of an electric field has often been utilized in order to distort ink flow in continuous type systems and to force the ejection of ink in drop on demand type systems.

One drop on demand type ink Jet printer configuration which utilizes the distortion of a piezoelectric material to eject ink includes a printhead forming an ink channel array in which the individual channels of the array each have side walls formed of a piezoelectric material. Typically, with respect to such arrays, the channels are micro-sized and are arranged so that the spacing between adjacent channels is relatively small. In operation of this type of printhead, ink is directed to and resides in the channels until selectively ejected therefrom. Ejection of ink from select channels is effected due to the electromechanical nature of the piezoelectric side walls of the channels. Because piezoelectric material deforms when an electric field is applied thereacross, the side walls of select channels may be caused to deform by applying an electric field thereacross. The electric field may be so selectively applied by digital or other means. This deformation of side walls of select channels reduces the volume of the respective channels creating a pressure pulse in the ink residing in those channels. The resultant pressure pulse then causes the ejection of a droplet of ink from the particular channel across which the electric field is applied.

In printing, the ink Jet printhead in a typical ink jet printer is mechanically caused to move across the print medium, selectively ejecting ink from particular ink channels of the printhead in its movement thereacross, to print a particular line of print characters. Once the line is completed, the print medium mechanically progresses through the printer to position the printhead at the next line of the print medium. At the next line of the print medium the process is repeated with the printhead moving across the print medium to print the particular line of print characters, the print medium thereafter progressing to position the printhead at the next line. These steps of printhead movement across the print medium followed by progression of the print medium to position the printhead are repeated in the printing process until the entire print medium passes through the printer.

Printhead movement across the print medium in printing a line of characters is necessary in the typical ink jet printer arrangement because the printhead in such an arrangement has been generally narrow in width. Printhead width has generally been narrow due to a number of factors, including, among others, the integrated circuitry necessary to activate and drive the printhead, the minimal spacing required between ink ejection ports to create desired uniform print quality in each line of print characters, and the limited space available for printhead movement and operation in most printers. Such a typical printhead of narrow width restricts printing speed since two mechanical steps, printhead movement across print medium and print medium progression, are required. A trade-off design limitation to printing speed in the typical ink Jet printer is print quality. Because the narrow printhead of the typical ink jet printer must be caused by digital or other means to selectively eject ink as the print medium is progressing through the printer and the printhead is simultaneously moving across the paper medium, print quality obtainable with such a printhead may be affected due to difficulties of timing ink ejection in coordination with print medium and printhead mechanical movement. There is, therefore, a trade-off between two limitations, printing speed and print quality, in the design of a narrow width printhead. It would be an improvement to overcome these limitations in ink jet printheads so that both printing speed and print quality could be increased in the same design without such trade-off limitations.

Attempts have been made to overcome these limitations by placing individual ones of the narrow printheads in a page wide alignment. In such an arrangement, individual ones of the narrow printheads are linked together to perform like a single-piece print bar. Ten to twenty individual printheads, instead of one united printhead, are required. Accuracy in alignment of the individual printhead nozzles in such an arrangement is critical to the quality of print from such a device, however, accuracy in alignment has heretofore been limited due to difficulties of linking the printheads to effect accurate alignment. Problems encountered in such an alignment of individual printheads include reduced print quality due to spacing requirements in aligning the printheads, a multiplicity of parts, for example, printheads and connector circuitry, leading to spacing limitations and increased malfunction risk, an involved manufacturing process comprising numerous steps with respect to each individual printhead and the integration thereof, and lack of positional accuracy due to limited means available to link the printheads and position printhead nozzles.

The present invention, being a page wide ink jet printhead comprising a single, united assembly integrating print nozzles, circuit connections and flip chip integrated circuits, and the method for manufacture thereof and printing thereby, overcomes these problems previously encountered.

SUMMARY OF THE INVENTION

The invention includes an ink Jet printhead employed in a printer for printing characters on a print medium, the print medium progressing in a path through the printer during printing. More particularly, one aspect of the invention includes a multiplicity of nozzles aligned in select positions across the print medium generally perpendicular to the path of the print medium and a means for selectively ejecting ink through the nozzles.

In another aspect, the invention includes a drop on demand type ink jet printhead which selectively ejects ink through particular nozzles in response to at least one electrical pulse acting upon the ejecting weans.

In a further aspect, the invention includes the above-described printhead, wherein the weans for selectively ejecting ink through said nozzles includes a PZT slab having a multiplicity of microgrooves formed in at least one surface thereof, each of the microgrooves being flooded with ink and in communication with at least one nozzle, the microgrooves being separated by metallized ridges forming sidewalls of the microgrooves, and a means for directing an electrical pulse to select metallized ridges to cause deformation of side walls of the microgrooves adjacent the metallized ridges thereby ejecting ink from the microgrooves through nozzles in communication with the microgrooves.

In yet another aspect, the invention includes the above described printhead wherein the means for directing an electrical pulse to the metallized ridges includes at least one flip chip electrically connected to the metallized ridges.

In another aspect, the invention includes the above described printhead wherein the PZT slab is elongate and the microgrooves and metallized ridges are formed longitudinally along the PZT slab.

In another aspect of the invention, the invention includes the above described printhead wherein the microgrooves and the metallized ridges are segregated into sections by a series of ink channels formed in the PZT slab, each of the ink channels interconnecting with adjacent sections of the microgrooves and having an ink dam along one edge to inhibit ink flow from the ink channel into microgrooves of the section adjacent that edge of the ink channel, each of the ink channels communicably interconnecting with microgrooves of the section adjacent the ink channel opposite the ink dam allowing ink flow into microgrooves within the section, and each of the microgrooves within each of the sections is in communication with at least one nozzle.

In yet another aspect, the invention includes the above described printhead wherein the means for directing an electrical pulse to the metallized ridges includes a plurality of flip chips, single ones of the flip chips being electrically connected with each of the metallized ridges within single ones of the sections.

In yet a further aspect, the invention includes the above described printhead further comprising a means, electrically connected with select ones of the plurality of flip chips, for mating with a source of select electrical signal.

The invention additionally relates to a drop on demand ink jet printhead employed in a printer for printing characters on a print medium, the printhead being of the type including a piezoelectric material having microgrooves therein with sidewalls of the microgrooves serving as actuators for ejection of ink from the microgrooves in response to electrical pulse applied to the sidewalls, the print medium progressing in a path through the printer during printing. More particularly, the invention includes the improvement comprising the piezoelectric material being configured as an elongate slab and having segregated sections of microgrooves, the sections being independently fed with ink and the sidewalls of the microgrooves within the sections being independently actuated, the sections being disposed across the print medium generally perpendicular to the path of the print medium, and a multiplicity of nozzles, single ones of the nozzles being located in communication with single ones of the microgrooves, the nozzles serving as orifices for ejection of ink droplets from the printhead.

The invention also relates to a method for page wide printing by means of a stationary printhead, the printhead being employed in a printer for printing characters on a print medium, the print medium progressing in a path through the printer during printing. More particularly, such method comprises the steps of aligning a multiplicity of nozzles in select positions across the print medium generally perpendicular to the path of the print medium, and ejecting ink through select ones of the nozzles.

In another aspect, the invention includes the above described method wherein the step of aligning includes cutting parallel microgrooves longitudinally in a PZT slab, covering the microgrooves in the PZT slab with a polymer sheet, and forming the nozzles in the polymer sheet by laser ablation.

In a further aspect, the invention includes the above described method wherein the step of ejecting includes flooding the microgrooves with ink and selectively deforming sidewalls of the microgrooves.

In yet another aspect, the invention includes the above described method wherein the step of selectively deforming sidewalls of the microgrooves includes applying an electric pulse selectively to the sidewalls of the microgrooves.

In yet a further aspect, the invention includes the above described method further comprising the step of coating metallized ridges atop the sidewalls separating the microgrooves with a metallic conductive layer for conduction of electric pulse therealong.

The invention additionally relates to a method for manufacturing a page wide ink Jet printhead. More particularly, the invention comprises the steps of cutting parallel microgrooves longitudinally in a PZT slab, the microgrooves having sidewalls which serve as actuators for ejection of ink from the microgrooves in response to an electrical pulse applied to the sidewalls, and segregating the microgrooves into sections, the sections to be independently fed with ink and sidewalls of microgrooves within the sections to be independently actuated.

In another aspect, the invention includes the above described method wherein the step of segregating includes cutting ink channels generally across the microgrooves of the PZT slab and forming an ink dam along one edge of each of the ink channels.

In another aspect, the invention includes the above described method further comprising the steps of coating metallized ridges separating the microgrooves with a metallic conductive layer, bonding a polymer sheet to the metallized ridges to cover the microgrooves, forming nozzles in the polymer sheet in communication with the microgrooves, and connecting the metallized ridges with flip chips for delivering select electrical pulse to select ones of the metallized ridges.

The invention also relates to a method for page wide ink Jet printing which includes the steps of progressing a print medium past a stationary printhead, the printhead formed with a multiplicity of nozzles aligned in select positions across the print medium generally perpendicular to the path of the print medium, and ejecting ink through select ones of the nozzles.

The invention additionally relates to the product print medium and product printheads obtained from the above described methods.

BRIEF DESCRIPTION OF THE DRAWINGS

For a more complete understanding of the present invention and for further objects and advantages thereof, reference may now be had to the following description in conjunction with the accompanying drawings, in which.

DETAILED DESCRIPTION

In order to fully understand the technology and novelty of the page wide printhead of the present invention, it is helpful to consider the operation characteristics of a typical "drop on demand" type ink jet printhead. Such a typical ink jet printhead is formed, at least in part, of a ceramic material, which is electromechanically active, for example, a piezoelectric material. At least one surface of the printhead is coated with gold or some other suitable metallic conductive layer. An array of closely spaced, longitudinally extending microgrooves is then cut in the metallized surface. Due to this manufacturing method, the microgrooves of the printhead are separated by ridges. Since the surface of the printhead was coated with a metallic conductive layer before the microgrooves were cut, these resulting ridges are surface coated with the metallic conductive layer. In the microgroove channels, however, the surfaces of the channels are not so coated. The metallic layered ridges between the microgrooved channels allow select application of electrical pulse to particular metallized ridges to create electrical field across particular microgroove channels. Because the microgroove channel walls are formed of an electromechanically activated material, the select application of electrical field causes deformation of the walls of select microgrooves. In operation of the typical printhead, ink is fed and resides within the microgroove channels. The wall deformation caused by select application of electric pulse to particular ridges creates a pressure pulse in the ink fluid resting in the microgroove channels adjacent the particular ridges and ink is ejected from the particular microgrooves out the printhead.

Figure 1:
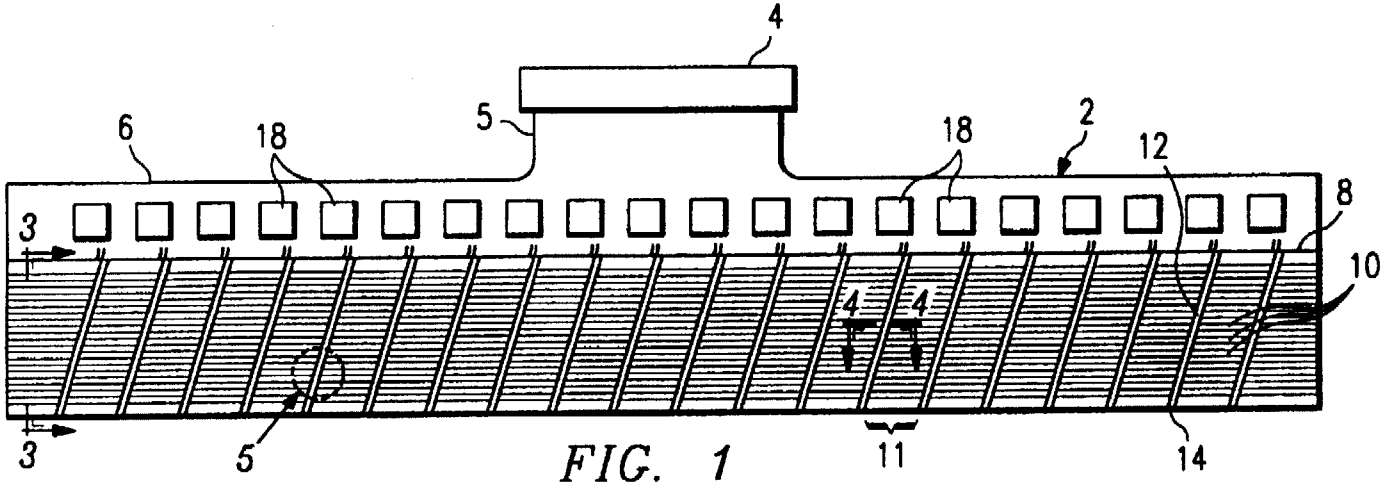
FIG. 1 is a front view of the page wide ink jet printhead.

Referring first to FIG. 1, a front view of the page wide printhead 2 of the present invention is shown. The page wide printhead operates in a manner similar to the operation of the typical drop on demand ink jet printhead just described, however, the page wide printhead allows for simultaneous ink ejection across the entire width of a page of print medium from a multiplicity of microgroove channels segregated into separate sections of microgroove arrays. Still referring to FIG. 1, the page wide printhead is formed on a printed circuit board ("PCB") 6. Typical materials and manufacturing methods are used in manufacturing and constructing the PCB 6. The PCB 6 is a generally elongate structure of approximately the length of a print medium page, for example, eight to twelve inches, and a width of one and one-half to two inches. The PCB 6 has a midsection extension 5 extending from the mid length of the PCB 6. The midsection extension 5 may be approximately four to five inches in length and one to two inches in width and sufficient for attachment therewith of a standard connector 4. The dimensions may differ from those described herein as the dimensions are to be tailored in light of the printer size and printing application. Other dimensions may be suitable in particular applications and the invention includes printheads of other dimensions. The connector 4, for example, a 20-pin connector or other connector suitable to the particular application, should be suitable for mating with an external source of select digital pulse or other electrical signal, for example, a printed circuit board connector in a printer (not shown in FIG. 1).

Still referring to FIG. 1, the page wide printhead 2 further includes a multiplicity of flip chips 18, for example, nineteen flip chips, bonded to the PCB 6 in an array along the top edge of the elongate portion thereof. As used herein, "flip chip" refers to a standard computer chip mounted upside down in a manner such that the clip directly interconnects by metallized bumps thereon with circuitry of the PCB. Flip chips are preferable due to the compactness thereof when installed in a PCB arrangement such as that described herein. A. preferred flip chip 18 for use in the printhead 2 is manufactured by or licensed from International Business Machines Corporation (IBM) according to what has been termed C4 technology. An Application Specific Integrated Circuit (ASIC) chip is preferable, although other computer chips, including standard chips having suitable circuitry, may be employed. The flip chips 18 are electrically connected, by methods hereinafter described, with the connector 4 and the metallized ridges 22 (shown in FIG. 3) of select microgrooves 10 within a particular section 11, as also hereinafter described, to activate select ink ejection throughout the entire length of the printhead 2 across the width of a page of paper medium. In a preferred arrangement of the printhead 2, the flip chips 18 are each located close to the metallized ridges 22 of select microgrooves 10 within a particular section 11 in order to limit signal crossover and optimize the electrical circuitry performance in the printhead 2.

Bonded along the lower edge of the elongate section of the PCB 6 is a piezoelectric slab ("PZT slab") 8. The PZT slab 8 includes an array of microgrooves 10 therein. The microgrooves 10 serve as channel reservoirs for holding ink until select ejection therefrom in response to electrical impulse. The microgrooves 10 extend for the entire length of the PZT slab 8. The PZT slab 8 is of approximately the same length as the PCB 6.

Located intermittently throughout the length of the PZT slab 8 and extending across the width thereof is located a series of ink channels 12. The ink channels 12 may be angled in relation to the width of the PZT slab 8. This angling allows for angled location of nozzles 26 (shown in FIG. 5) as later described herein. The ink channels 12 separate the microgrooves 10 into distinct sections 11. The number of sections 11 corresponds with the number of flip chips 18. As later more fully described, each flip chip 18 is electrically connected with the connector 4 and particular metallized ridges 22 (shown in FIG. 3) of the microgrooves 10 so as to selectively direct formation of electric field across particular microgrooves 10 within a single section 11 of the PZT slab 8 in response to electrical direction acting at the connector 4 from the external source of select digital pulse or other electrical signal.

The ink channels 12 are each separately fed by individual ink feeds 14. Ink from an external source, preferably incorporated in a printer with which the printhead 2 is used (not shown), flows through the ink feeds 14 into the ink channels 12. Each ink channel 12 connects with microgrooves 10 in a particular section 11 between the ink channel 12 and the next successive ink channel 12 along the PZT slab 8 to feed ink to the microgrooves 10 in the section 11. The ink feeds 14 of particular or all ink channels 12 may be connected by a common system, which system may include a common channel formed in the PZT slab 8 or separate channel or tubing systems which interconnect to feed the ink channels 12.

Figure 2:
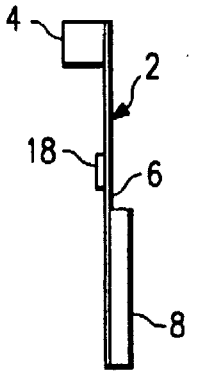
FIG. 2 is a right side view of the page wide ink Jet printhead.

Referring now to FIG. 2, a left side view of the printhead 2 is shown. The side view shows the relation of the connector 4, flip chips 18 and PZT slab 8 as mounted on the PCB 6. The particular arrangement of the connector 4, flip chips 18 and PZT slab 8 are purely a matter of choice dictated by the particular printer in which the printhead 2 is to be used, including space and configuration design parameters thereof. The connector 4 is electrically connected with the various flip chips 18 so that digital electrical pulse selectively applied to the pins of the connector 4, through the mated connection of the connector with an external source of select digital pulse or other electrical signal, for example, a printed circuit board connector incorporated in a printer, directs a select pulse response to particular ones of the flip chips 18. The flip chips 18 are further selectively electrically connected with metallized ridges 22 (shown in FIG. 3) of particular microgrooves 10 within a section 11 of the PZT slab 8 in a manner such that each flip chip 18 controls and sends electrical pulse directed to select metallized ridges 22 of particular microgrooves 10 within the section 11.

Figure 3:
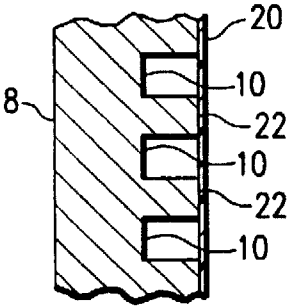
FIG. 3 is an enlarged, partial cross sectional view of the page wide ink Jet printhead of FIG. 1 taken along lines 3—3, illustrating the microgrooves of the printhead.

Referring now to FIG. 3, a detailed cross sectional view of several of the microgrooves 10 of the PZT slab 8 is shown. The PZT slab 8 should be of generally uniform thickness, greater than the depth of the microgrooves 10 cut therein. Prior to cutting the microgrooves 10, the PZT slab 8 is coated upon at least one surface with a metallic conductive layer, for example, a gold coating. The microgrooves 10 are then cut in the coated surface of the PZT slab 8. The microgrooves 10 are preferably formed longitudinally along the PZT slab 8 from end to end thereof. The microgrooves could be formed by any of a number of methods, including laser, water Jet, chemical milling, or sawing, however, a preferred method includes cutting the surface of the PZT slab 8 by use of a dicing saw, for example, a Disco High Precision Dicing Saw, Model No. DAC-25P/86. The microgrooves are typically quite small, for example, on the order of about 80–90 μm in width, having channel depths, for example, of about 300–500 μm, and are closely spaced, for example, to within about a 100–200 μm pitch, in an array across the width of the PZT slab 8.

After the microgrooves 10 are cut in the PZT slab 8, the PZT slab 8 then includes at least one surface having an array of microgrooves 10, the channels of which are exposed piezoelectric material. The metallized ridges 22 between the microgrooves 10 remain surface layered with the metallic conductive coating. The metallic conductive coating along the metallized ridges 22 serves as an electric circuit to conduct electrical pulse therealong.

Figure 4:
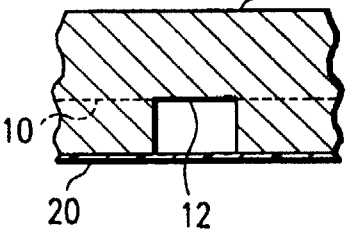
FIG. 4 is an enlarged, partial cross sectional view of the page wide ink Jet printhead of FIG. 1 taken along lines 4—4, illustrating an ink channel and the relationship of the channel with microgrooves of the printhead.

Referring now to FIG. 4, a cross section illustrating interconnection of an ink channel 12 and microgrooves 10 of a section 11 of the PZT slab 8 is shown. Once the microgrooves 10 are formed in the PZT slab 8, wider cuts are made generally diagonally across the width of the PZT slab 8 to form ink channels 12. The ink channels 12 serve as ink feed conduits to the microgrooves 10. The ink channels 12 are preferably cut to approximately the same depth in the surface of the PZT slab 8 as the microgrooves 10. As previously described, each ink channel 12 is fed by an ink feed 14. The ink feed 14 serves to flow ink into the ink channel 12 to feed microgrooves 10 of a particular section 11 of the PZT slab 8.

After the microgrooves 10 and ink channels 12 are formed in the PZT slab 8, the PZT slab 8 is bonded to the PCB 6, for example, by solder or conductive or epoxy adhesive. The PZT slab 8 is preferably bonded so that the surface of the PZT slab 8 having the microgrooves 10 therein faces away from the PCB 6. This bonding arrangement allows for formation of nozzles 26 at such surface, as hereinafter described, so that ink is ejected from select microgrooves 10 in a direction normal to the PZT slab 8 onto a paper medium located relative to the microgrooved surface thereof.

Figure 5:
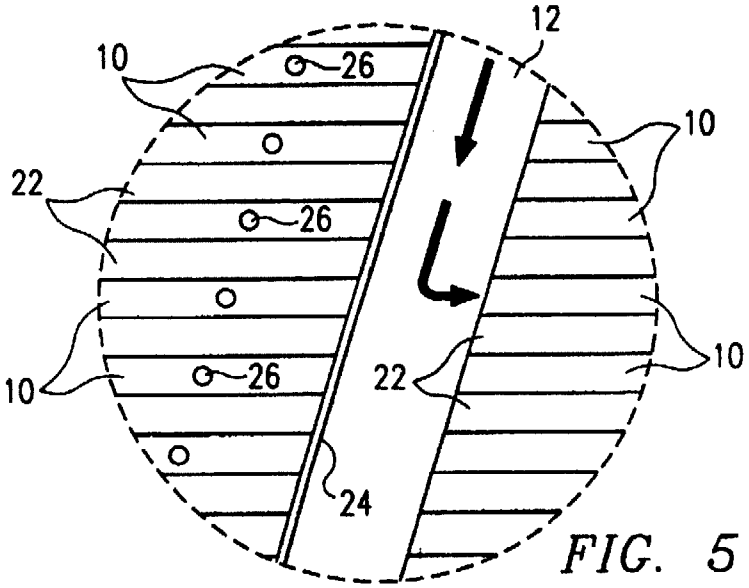
FIG. 5 is an enlarged, sectional front view taken at circle 5 of FIG. 1, showing the relationship of orifices, microgrooves, and an ink channel of the printhead.

Referring now to FIG. 5, an enlarged partial section taken from the front view of the printhead 2 of FIG. 1 is shown. The figure illustrates that, due to the manufacturing methods previously described herein, the microgrooves 10 are separated into two distinct sections 11 by the ink channel 12. Along one edge of the ink channel 12 is placed an ink dam 24. The ink dam 24 may be poured or spread along such edge of the ink channel 12 and should be formed of an impervious material, resistant to ink, which hardens after application, for example, an epoxy or adhesive, to permanently restrict ink flow within the ink channel 12 from crossing the ink dam 24. The ink dam 24, by restricting flow from the ink channel 12, limits flow of ink directed into the ink channel 12 into microgrooves 10 of only one section 1 1 adjacent the ink channel 12. Each ink channel 12 includes such an ink dam 24 and, therefore, feeds only a single, particular section 1 1 of microgrooves 10 adjacent to the ink channel 12.

Still referring to FIG. 5, the metallized ridges 22 are shown situated between adjacent macrogrooves 10. As previously described, the metallized ridges 22 are, due to the manufacturing method, surface layered with conductive metallic coating. The metallized ridges 22 of a particular section 11 correspond and electrically communicate with a single flip chip 18 due to electrical interconnection therewith. Due to such communication, a pulse received through the connector 4 of the PCB 6, having been directed to a particular flip chip 18, is then, due to such flip chip's 18 interconnection with metallized ridges 22 of a particular section 11 of microgrooves 10, directed by the flip chip 18 to particular ones of the metallized ridges 22 within the section 11 causing deformation of walls of select microgrooves 10 adjacent the particular metallized ridges 22. This electrical connection of flip chips 18 with particular metallized ridges 22 of particular sections 11 of the microgrooves 10 allows select creation of electric fields across particular ones of the microgrooves 10 within the section 11. As previously described, the PZT slab is formed of a piezoelectric material, thus, the walls of the microgrooves 10 are also formed of such material. The creation of electric field across particular ones of the microgrooves 10 due to electric pulse directed along adjacent metallized ridges 22 causes deformation of the particular microgroove 10 walls and creation of a pressure pulse within the microgroove 10 channel. In operation, ink stored within the microgroove 10 channel is ejected from the channel due to the pressure pulse caused by the wall deformation.

Once the microgrooves 10 and ink channels 12 are cut in the PZT slab 8 and the ink dam 24 is placed along one side of each ink channel 12, the PZT slab 8 is covered on the microgrooved surface by a polymer sheet 20 (shown in detail in FIGS. 3 and 4) formed of a polymer such as kapton. This polymer sheet 20 is bonded to the surface of the PZT slab 8 by a thermoplastic polyimide or epoxy adhesive. The polymer sheet 20 serves to encapsulate the microgrooves 10 and the ink channels 12 to prevent leakage of ink fed thereto.

Electrical interconnects between the flip chips 18 and metallized ridges 22 are preferably formed after bonding of the polymer sheet 20. Once the polymer sheet 20 is bonded, holes in the polymer sheet 20 for electrical interconnect vias may be formed by laser ablation at select points at the metallized ridges 22. These holes allow for electrical connection of the metallized ridges 22 with the flip chips 18 to form select circuitry connecting select metallized ridges 22 of a particular section 11 with a particular flip chip 18. After the electrical interconnect vias are formed, metal electrical connections are formed by plating or sputtering metal into the vias. Then, a photo resist mask followed by exposure to a sputter metal pattern and removal of the photo resist is employed to create a desired circuitry on the PCB 6 for interconnecting flip chips 18 with metallized ridges 22 of particular sections 11. These electrical interconnects could alternatively be formed by incorporating all necessary circuitry into the PCB 6 and retaining exposed metallized areas at select locations for flip chip 18 interconnection. The flip chips 18 may then be positioned and fixed by solder or a conductive adhesive, for example, a Z-axis adhesive, at these select locations to complete the circuitry.

Also as shown in FIG. 5, each microgroove 10 is in communication with a nozzle 26. The nozzle 26 serves to allow ejection of ink from the particular microgroove 10. The nozzles 26 are preferably formed at the segments of the microgrooves 10 opposite the ink channel 12 feeding the particular section 11 of microgrooves 10. The nozzles 26 are further preferably formed at an angle to the width of the PZT slab 8, for example, a 0 to 90 degree angle, to vary the distance between adjacent nozzles 26 along the length of the PZT slab 8, thereby allowing variation of the dot per inch capability of the printhead 2 due to the particular angle. The angle variation changes the distance between adjacent nozzles 26 if, as is the preferred arrangement, the nozzles 26 are arranged across the print medium generally perpendicular to the path of the print medium through the printer. The nozzles may further be staggered in relation to microgrooves 10 to increase print quality in certain applications. Such staggering can be employed to eliminate the effects on adjacent microgrooves 10 of deformation of walls of select microgrooves 10. The nozzles 26 may be formed by creating nozzle holes in the polymer sheet 20, for example, by a laser ablation technique. A typical nozzle 26 hole size is about 40 μm in diameter, although any of a variety of other hole sizes and/or shapes may be employed. Forming the nozzles 26 in such manner allows for ejection of ink through the nozzles 26 in a direction normal to the microgrooved surface of the PZT slab 8. This configuration of the nozzles 26 with respect to the PZT slab 8 allows for ink to be directed in a direction normal to a print medium placed in front of the printhead 2.

The circuitry of the PCB 6 formed as previously described may be connected with particular flip chips 18 by a number of methods. A preferred method of interconnecting the PCB 6 circuitry at the flip chips 18 includes forming metallization vias through the polyimide at each flip chip 18 by laser ablation, then forming a bond pad area thereon by photo resist masking, and then plating or sputtering metal into the vias to complete the electrical connection. Alternatively, electrical circuitry could be incorporated in the PCB 6 and exposed metallized areas at select locations for flip chip 18 interconnection could be formed or retained in the PCB 6 to allow for solder or conductive adhesion of the flip chips 18 at such locations.

In operation, the page wide printhead 2 of the present invention is connected by the connector 4 with a mating connector of a printer or other source of select electrical signal. The printhead 2 is preferably positioned so that the print medium is located parallel to the surface of the microgrooved PZT slab 8 of the printhead 2 and progresses through the printer along a path perpendicular to the length of the PZT slab 8. When positioned in this manner, ink ejected from particular microgrooves 10 through nozzles 26 formed in the polymer sheet 20 disposed across the surface of the PZT slab 8 are directed towards the print medium in a normal direction thereto. The ejected ink droplets are thereby deposited on the print medium in select configurations to form print characters. The printhead 2 can, by varying the nozzle 26 configuration and arrangement, have a varying range of resolution. In a preferred embodiment, the nozzles 26 are configured to provide a 300 dot per inch resolution, although other resolutions are possible ranging, for example, from about 75 dots per inch or less to in excess of 1200 dots per inch. The printhead 2 may be either stationary in relation to the width of the print medium or the printhead 2 could be mechanically movable across the width of the print medium to the extent necessary to print characters throughout the entire width of the print medium. In a preferred embodiment, the printhead 2 does not move across the width of the print medium, thereby limiting the necessary mechanics of the printer to progression of the print medium lengthwise past the printhead 2. In such a preferred embodiment, printing speed is increased due to the single mechanical movement of the print medium progressing through the printer and increased dot per inch resolution capability is achievable without loss of print quality since the printhead 2 may print page wide without movement across the print medium.

As is seen, the present invention overcomes the problems presented by the prior art narrow printhead which moves across the print medium during printing and of the prior attempts at page wide printing by linking individual, narrow printheads. In particular, the present invention provides for simplified construction of a page wide printhead requiring minimal parts and incorporating appropriate alignment of nozzles through the manufacturing process for the printhead. The page wide printhead exhibits significantly improved positional accuracy of the nozzles due to the manufacturing method and the fixed securement of the nozzles in such positioning.

The foregoing detailed description is to be clearly understood as being given by way of illustration and example only, the spirit and scope of the present invention being limited solely by the appended claims.

What is claimed is:

1. A method for manufacturing a page wide ink printhead, comprising the steps of:

cutting parallel microgrooves longitudinally in a PZT slab, said microgrooves having sidewalls which serve as actuators for ejection of ink from said microgrooves in response to an electrical pulse applied to said sidewalls;

segregating said microgrooves into sections, said sections to be independently fed with ink and sidewalls of microgrooves within said sections to be independently actuated, wherein said step of segregating includes cutting ink channels generally across said microgrooves of such PZT slab and forming an ink dam along one edge of each of said ink channels.

2. The method of claim 1, further comprising the step of:

coating metallized ridges separating said microgrooves with a metallic conductive layer.

3. The method of claim 2, further comprising the step of:

bonding a polymer sheet to said metallized ridges to cover said microgrooves.

4. The method of claim 3, further comprising the step of:

forming nozzles in said polymer sheet in communication with said microgrooves.

5. The method of claim 4, further comprising the step of:

connecting said metallized ridges with flip chips for delivering select electrical pulse to select ones of said metallized ridges.

6. A printhead manufactured by the method of claim 1.

7. A printhead manufactured by the method of claim 2.

8. A printhead manufactured by the method of claim 3.

9. A printhead manufactured by the method of claim 4.

10. A printhead manufactured by the method of claim 5.

* * * * *